US011488817B2

(12) United States Patent
Gonzalez et al.

(10) Patent No.: US 11,488,817 B2
(45) Date of Patent: Nov. 1, 2022

(54) MASS SPECTROMETRY SWEEP CONE CLEANING BY MEANS OF ULTRASONIC VIBRATION

(71) Applicant: Thermo Finnigan LLC, San Jose, CA (US)

(72) Inventors: David Gonzalez, Austin, TX (US); Nathaniel L. Sanders, Austin, TX (US); Joshua T. Maze, Round Rock, TX (US)

(73) Assignee: Thermo Finnigan, San Jose, CA (US)

( * ) Notice: Subject to any disclaimer, the term of this patent is extended or adjusted under 35 U.S.C. 154(b) by 757 days.

(21) Appl. No.: 16/512,617

(22) Filed: Jul. 16, 2019

(65) Prior Publication Data

US 2021/0020424 A1 Jan. 21, 2021

(51) Int. Cl.

| | |
|---|---|
| ***H01J 49/16*** | (2006.01) |
| ***H01J 49/26*** | (2006.01) |
| *H01J 49/24* | (2006.01) |

(52) U.S. Cl.

CPC ..... *H01J 49/168* (2013.01); *H01J 49/26* (2013.01); *H01J 49/24* (2013.01); *H01J 2209/017* (2013.01)

(58) Field of Classification Search

CPC ..... H01J 49/168; H01J 49/26

See application file for complete search history.

(56) References Cited

U.S. PATENT DOCUMENTS

| | | | |
|---|---|---|---|
| 2009/0236518 | A1 | 9/2009 | Kobayashi |
| 2014/0264003 | A1 | 9/2014 | Di Bussolo |
| 2020/0013605 | A1 | 1/2020 | Morris et al. |
| 2020/0018733 | A1 | 1/2020 | Bajic et al. |

FOREIGN PATENT DOCUMENTS

| | | | |
|---|---|---|---|
| WO | 2012/150958 | A1 | 11/2012 |
| WO | 2019/102350 | A1 | 5/2019 |

OTHER PUBLICATIONS

Sakairi et al., "An Interface for Liquid Chromatograph/Mass Spectrometer Using Atmospheric Pressure Ionization Coupled with a Nebulizing Sample Introduction System", Mass Spectrometry (1983), pp. 87-95.

Xiao, et al., "Compound coverage enhancement of electrosprayionization mass spectrometry through the addition of ahomemade needle", Analyst, 2013, 138, pp. 1772-1778.

*Primary Examiner* — Joseph L Williams

(57) ABSTRACT

A method for removing deposits in a mass spectrometer ion source housing includes delivering a liquid from a liquid source to a surface within the ion source housing. The surface including an ultrasonic transducer embedded within the surface. The method further includes activating the ultrasonic transducer to ultrasonically remove the deposit.

21 Claims, 7 Drawing Sheets

MASS SPECTROMETRY SWEEP CONE CLEANING BY MEANS OF ULTRASONIC VIBRATION

FIELD

The present disclosure generally relates to the field of mass spectrometry including cleaning of sweep cones by means of ultrasonic vibration.

INTRODUCTION

Mass spectrometry can be used to identify and quantitate components of a sample, and has become widely used in various fields including forensics, medicine, food safety, quality assurance/quality control, and the like. Often, mass spectrometry systems are configured for high volume testing, and when combined with an autosampler, system utilization can approach 24 hours a day in many instances. However, since the mass spectrometry system operates under vacuum, routine maintenance can take a system offline for many hours as, the system is vented, parts are replaced/cleaned, the vacuum is restored, and system calibrations are performed. The significant time required whenever a system requires maintenance can represent a significant loss in production from a system that can operate near continuously. From the foregoing it will be appreciated that a need exists for more robust systems and methods to reduce instrument downtime.

SUMMARY

In a first aspect, a method for removing deposits in a mass spectrometer ion source housing can include delivering a liquid from a liquid source to a surface within the ion source housing, and activating an ultrasonic transducer embedded within the surface to ultrasonically remove the deposit.

In various embodiments of the first aspect, the surface can be a sweep cone or a sweep cone shield.

In various embodiments of the first aspect, the liquid source can be an electrospray ionization source or a nebulizer of an APCI source.

In various embodiments of the first aspect, the mass spectrometer can be a liquid chromatography-mass spectrometer or an ion chromatography-mass spectrometer.

In various embodiments of the first aspect, applying the liquid and activating the ultrasonic transducer can occur during a cleaning cycle to remove deposited material from the sweep cone shield. In particular embodiments, the method can further include changing the volume of a nebulizer gas supplied to the liquid source and or changing the flow of liquid to the liquid source to increase the size of drops delivered to the surface during the cleaning cycle.

In various embodiments of the first aspect, activating the ultrasonic transducer can occur during ionization to reduce the amount of material deposited on the surface.

In a second aspect, a liquid based ion source housing of a mass spectrometer can include a liquid-based ion source and a sweep cone including an imbedded ultrasonic transducer. The liquid-based ion source can include a needle for delivery of a liquid, a nebulizer gas conduit to provide a nebulizer gas, and a heater.

In various embodiments of the second aspect, the liquid based ion source housing can further include an ion source controller. The ion source controller can be configured to control a volume of nebulizer gas supplied to the liquid-based ion source, control the heater, and activate the ultrasonic transducer. In particular embodiments, the ion source controller can be further configured to change the volume of nebulizer gas to flow a liquid onto the sweep cone while the ultrasonic transducer is activated to remove deposited material from the sweep cone. In particular embodiments, the ion source controller is further can be configured to activate the ultrasonic transducer during ionization to reduce the amount of material deposited on the sweep cone.

In various embodiments of the second aspect, the liquid-based ion source can be an electrospray ionization source.

In various embodiments of the second aspect, the liquid-based ion source can be an atmospheric pressure chemical ionization source and further includes a corona discharge needle.

In various embodiments of the second aspect, the mass spectrometer can be a liquid chromatography-mass spectrometer or an ion chromatography-mass spectrometer.

In a third aspect, a liquid based ion source housing of a mass spectrometer can include a liquid-based ion source, a sweep cone, and a sweep cone shield including an imbedded ultrasonic transducer. The liquid-based ion source can include a needle for delivery of a liquid, a nebulizer gas conduit to provide a nebulizer gas, and a heater.

In various embodiments of the third aspect, the liquid based ion source housing can further include an ion source controller configured to control a volume of nebulizer gas supplied to the liquid-based ion source; control the heater; and activate the ultrasonic transducer. In particular embodiments, the ion source controller can be further configured to change the volume of nebulizer gas to flow a liquid onto the sweep cone while the ultrasonic transducer is activated to remove deposited material from the sweep cone shield.

In various embodiments of the third aspect, the ion source controller can be further configured to activate the ultrasonic transducer during ionization to reduce the amount of material deposited on the sweep cone shield.

In various embodiments of the third aspect, the liquid-based ion source can be an electrospray ionization source.

In various embodiments of the third aspect, the liquid-based ion source can be an atmospheric pressure chemical ionization source and further includes a corona discharge needle.

In various embodiments of the third aspect, the mass spectrometer can be a liquid chromatography-mass spectrometer or an ion chromatography-mass spectrometer.

DRAWINGS

For a more complete understanding of the principles disclosed herein, and the advantages thereof, reference is now made to the following descriptions taken in conjunction with the accompanying drawings, in which.

Figure 1:
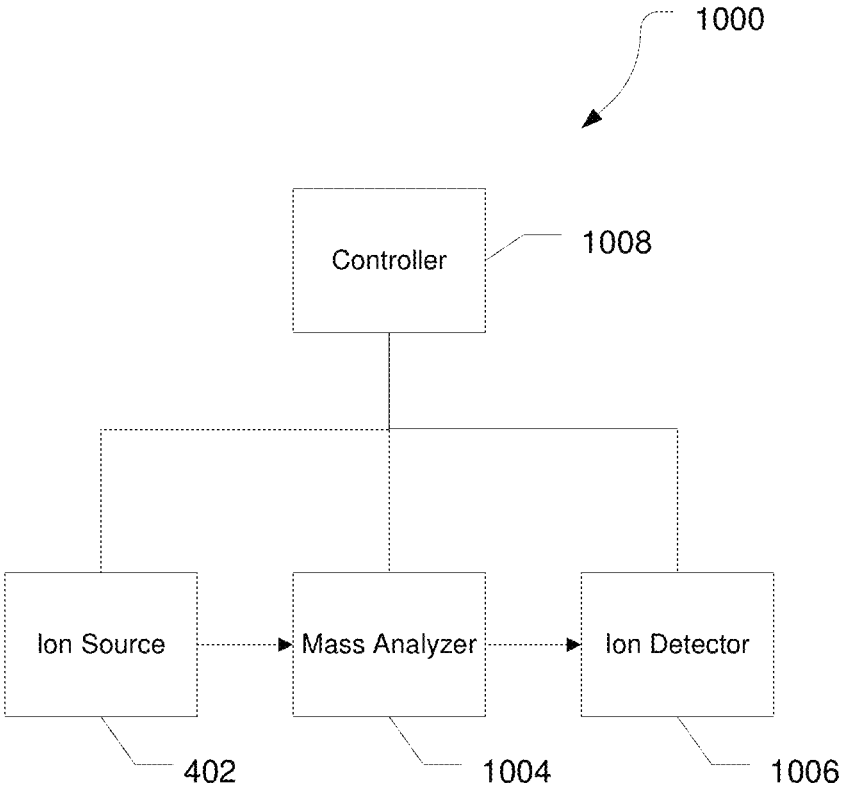
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion separation are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass-to-charge ratio of the ions. For example, the mass analyzer 104 can include a quadrupole mass filter analyzer, a quadrupole ion trap analyzer, a time-of-flight (TOF) analyzer, an electrostatic trap (e.g., Orbitrap) mass analyzer, Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Ion Source

Figure 2A:
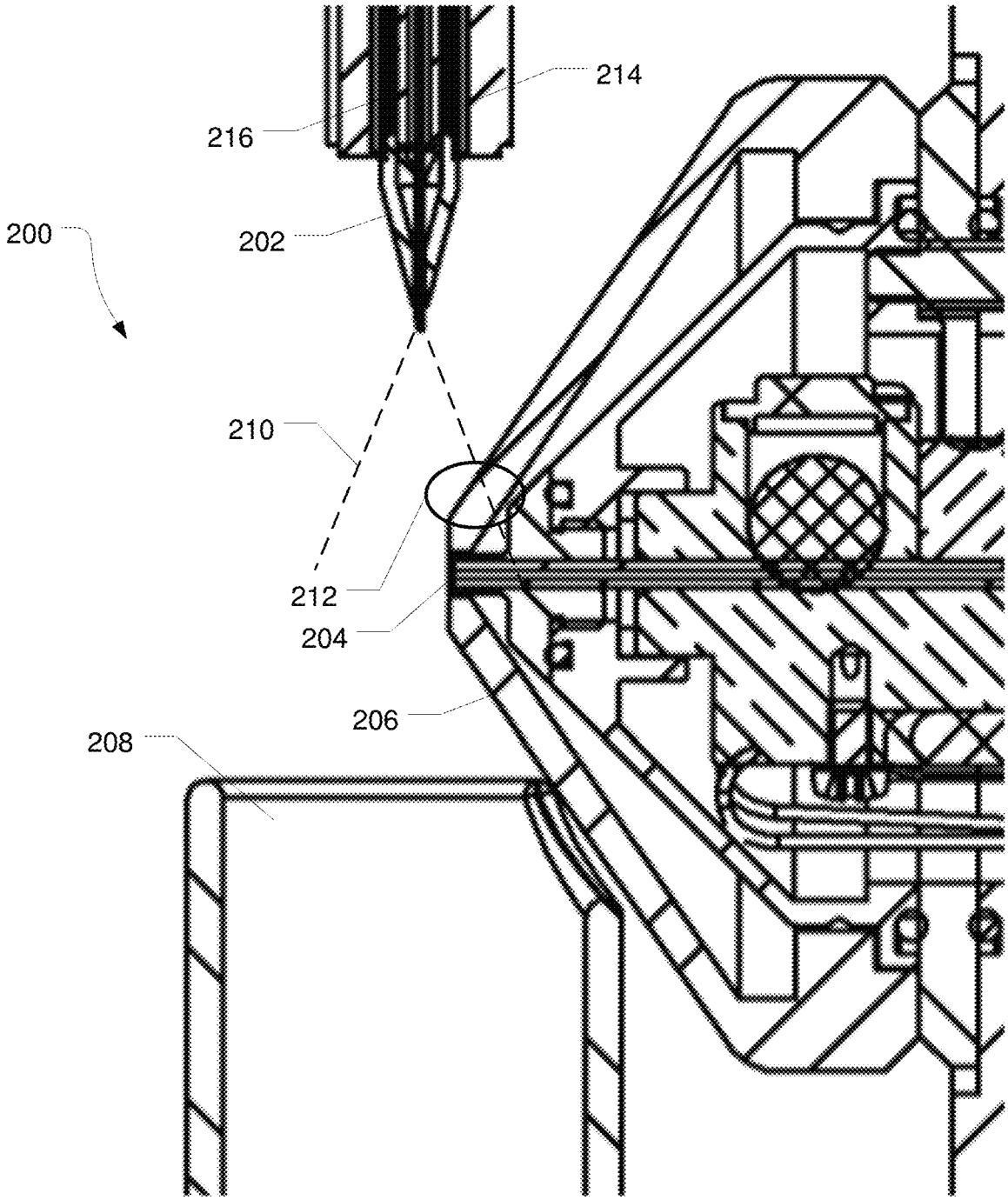
FIGS. 2A and 2B are diagrams illustrating exemplary electrospray ion sources, in accordance with various embodiments.
Figure 2B:
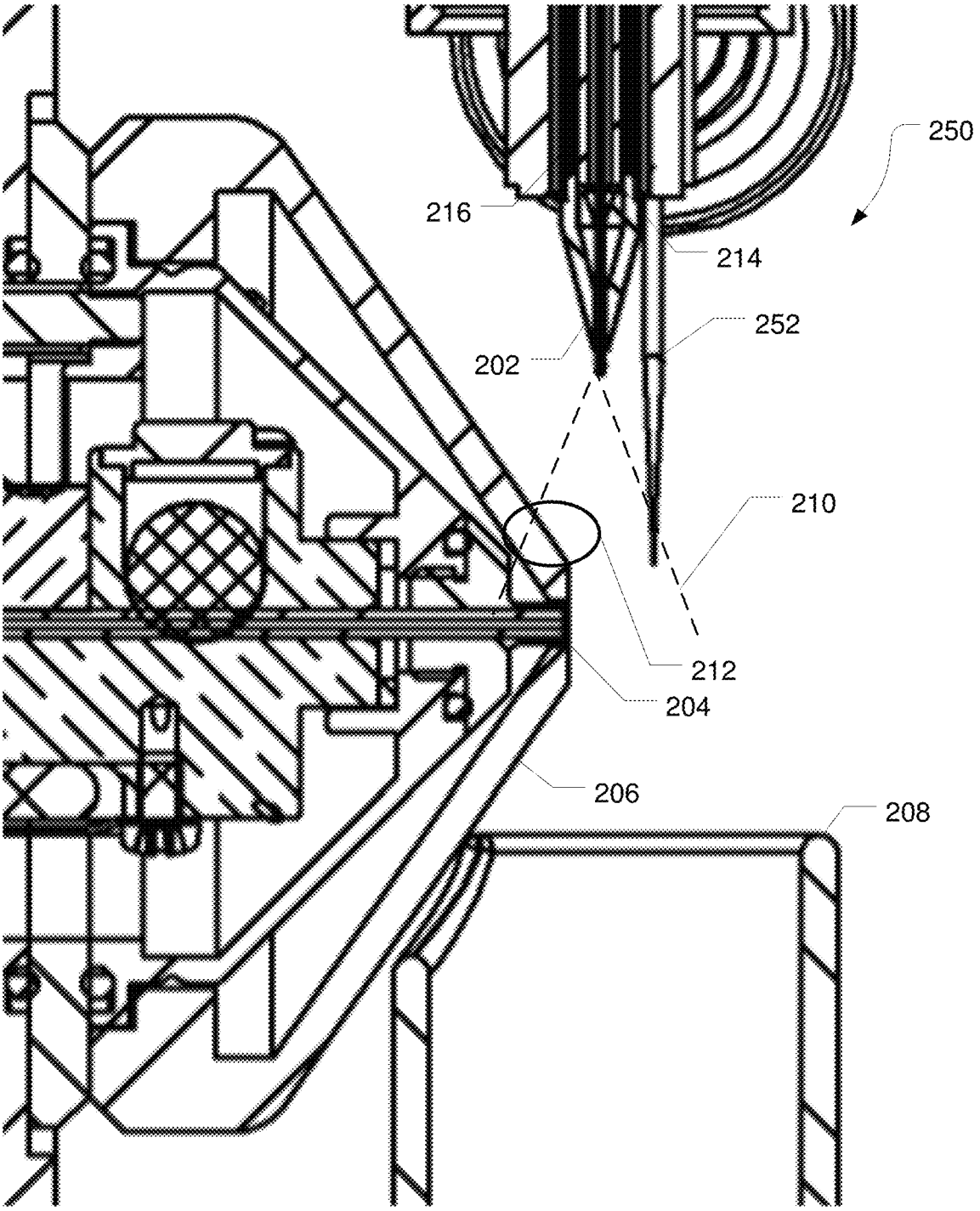

FIG. 2A shows an ion source 200 including a spray needle 202, an ion transfer tube 204, a sweep cone 206, and a drain tube 208. FIG. 2B shows a similar ion source 250 including a spray needle 202, an ion transfer tube 204, a sweep cone 206, a drain tube 208, and a corona discharge electrode 252.

Spray needle 202 can produce a nebulized mist 210 of a solution containing a solvent and one or more ionizable species. Using techniques such as electrospray ionization, thermal ionization, and the like, ions can be formed as the solvent is removed from the droplets. Additionally, ion source 200 or 250 can include a nebulizing gas conduit 214 and a heater 216. Heater 216 can heat a nebulizing gas flow as it moves through the nebulizing gas conduit. The nebulizing gas can aid in producing the nebulized mist 210 and desolvating the droplets. Alternatively, using atmospheric pressure chemical ionization, the solvent can be removed from the droplets, molecules can be ionized by the corona discharge electrode 252. A portion of the ions can be drawn into the ion transfer tube 204. These ions can then be analyzed using mass spectrometry.

Not all of the nebulized mist 210 is ionized and drawn into the ion transfer tube 204. A significant portion of the solvent can be evaporated resulting in a solvent-rich gas flow. Additionally, some droplets may not be fully desolvated. Drain tube 208 provides a path for excess droplets as well as solvent rich gases to exit the ion source 200.

However, the optimal placement of the entrance to the ion transfer tube 204 is near the center of the nebulized mist 210. Such placement allows the ion transfer tube 204 to sample the portion of the nebulized mist 210 with a high concentration of ions. As a result of the placement, a portion of the nebulized mist 210 impacts the sweep cone 206. This can result in an accumulation of material on the surface of the sweep cone 206 at location 212. Eventually the buildup of material can require cleaning the sweep cone 206.

Figure 3:
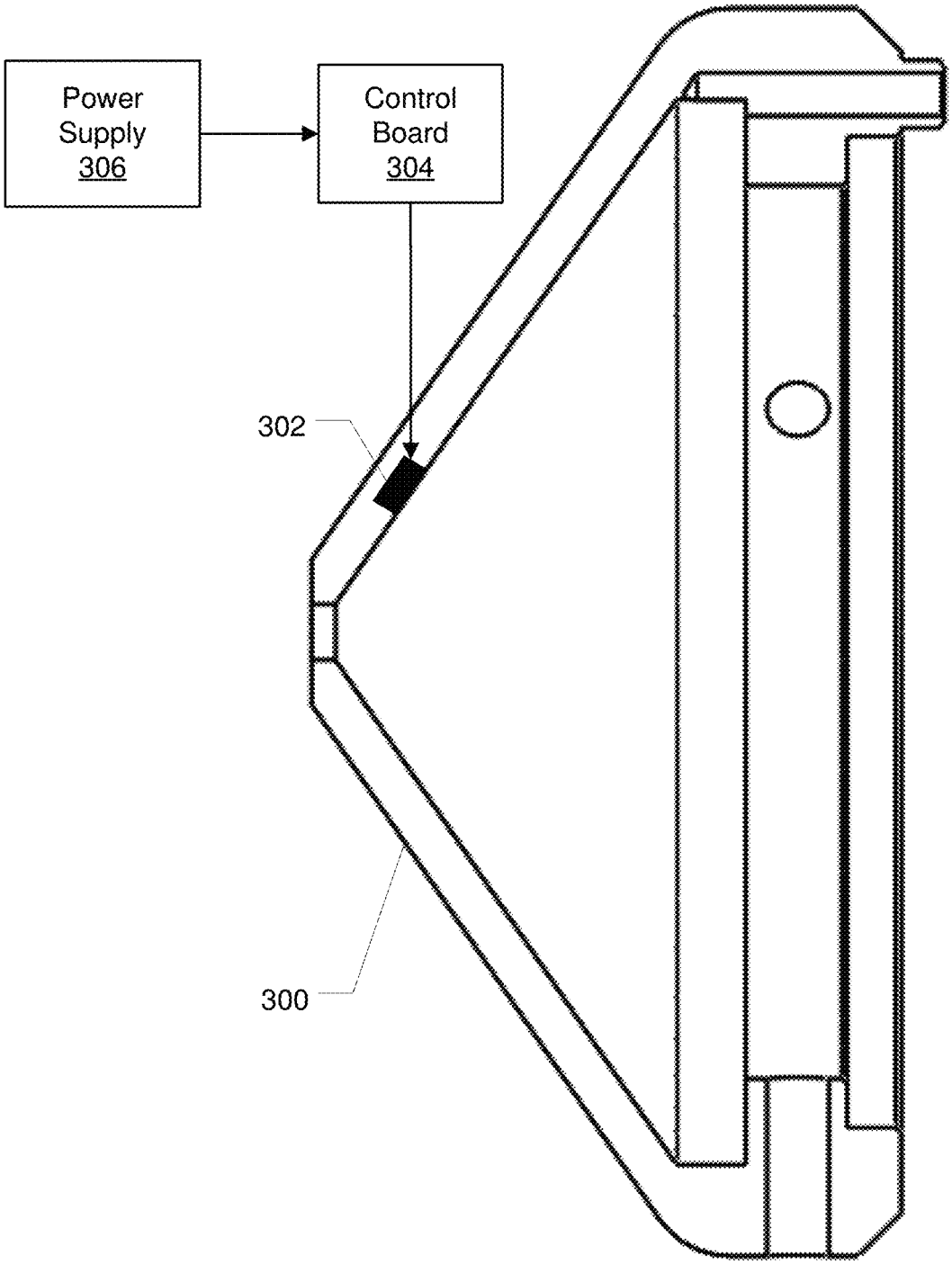
FIG. 3 is a diagram illustrating an exemplary sweep cone with an ultrasonic transducer, in accordance with various embodiments.

FIG. 3 illustrates an exemplary sweep cone 300 with an embedded ultrasonic transducer 302. Control board 304 can regulate the frequency of the embedded ultrasonic transducer 302. Additionally, power supply 306 can provide power to control board 304 and through the control board 304 to embedded ultrasonic transducer 302. The ultrasonic transducer 302 can be activated to reduce or remove the material deposited on the sweep cone. The ultrasonic transducer 302 can be activated during operation of the ion source to shed the droplets impacting the surface of the sweep cone 300 and significantly reduce the accumulation of deposited material. Alternatively, the ultrasonic transducer 302 can be activated during a cleaning cycle to remove accumulated material. During the cleaning cycle, a solvent may be supplied to the surface of the sweep cone, either through the spray needle or through an alternate delivery means, to aid in removal of the material.

Figure 4:
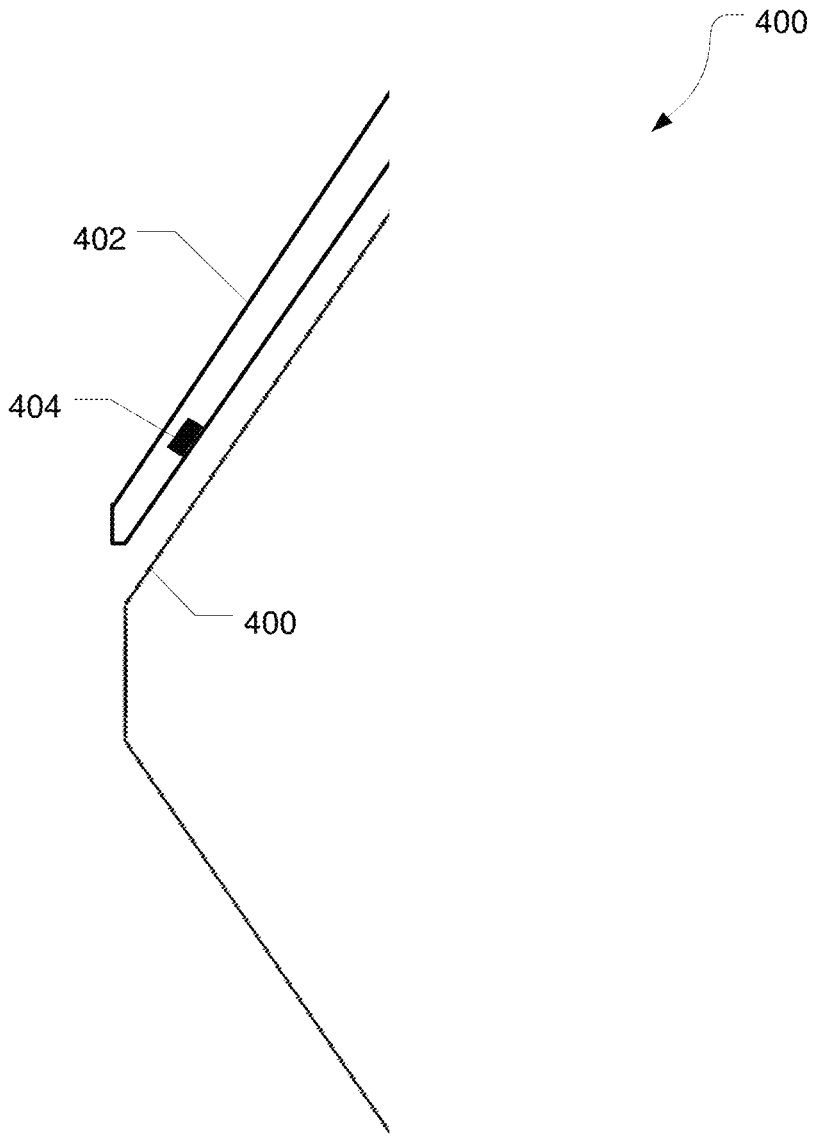
FIG. 4 is a block diagram illustrating an exemplary sweep cone shield with an ultrasonic transducer, in accordance with various embodiments.

FIG. 4 illustrates an exemplary sweep cone 400 with a sweep cone shield 402. An ultrasonic transducer 302 can be embedded in the sweep cone shield 402. Sweep cone shield 402 can substantially block the spray from reaching the surface of the sweep cone 400, thereby preventing deposition of material on the sweep cone 400. The ultrasonic transducer 302 can be activated to reduce or remove the material deposited on the sweep cone shield 402. As with the sweep cone of FIG. 3, the ultrasonic transducer 404 can be activated during operation of the ion source or during a cleaning cycle to reduce build-up on or remove accumulated material from the sweep cone shield.

Figure 5:
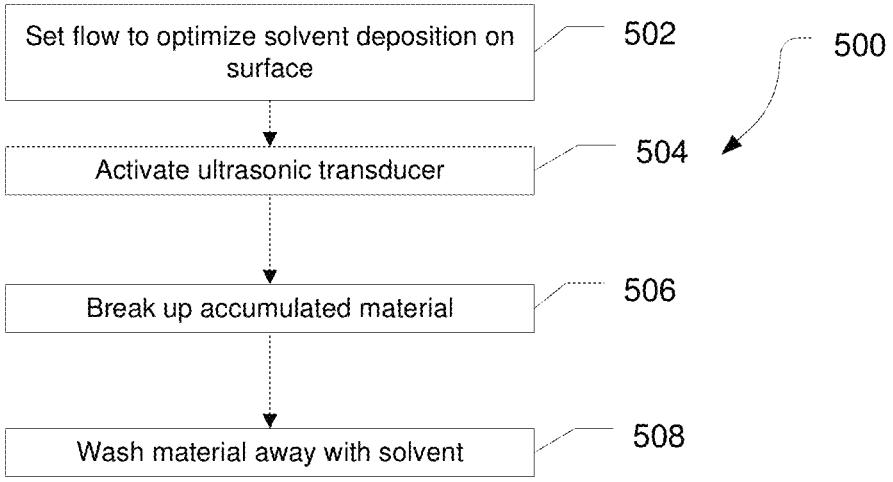
FIG. 5 is a flow diagram illustrating an exemplary method for cleaning a surface of an ion source, in accordance with various embodiments.

FIG. 5 illustrates an exemplary method 500 of cleaning a surface of an ion source housing, such as a sweep cone or a sweep cone shield. At 502, a solvent flow, and an optional gas flow, can be adjusted to deposit solvent on the surface to be cleaned. In various embodiments, the solvent flow and gas flow can be provided by a spray needle. Alternatively, a wash tube can be provided to flow solvent on the surface.

At 504, an ultrasonic transducer embedded in or otherwise attached to the surface can be activated to cause ultrasonic vibrations at the surface. At 506, the ultrasonic vibrations can act to breakup and lift the accumulated material, which can be washed away using the solvent at 508.

Figure 6:
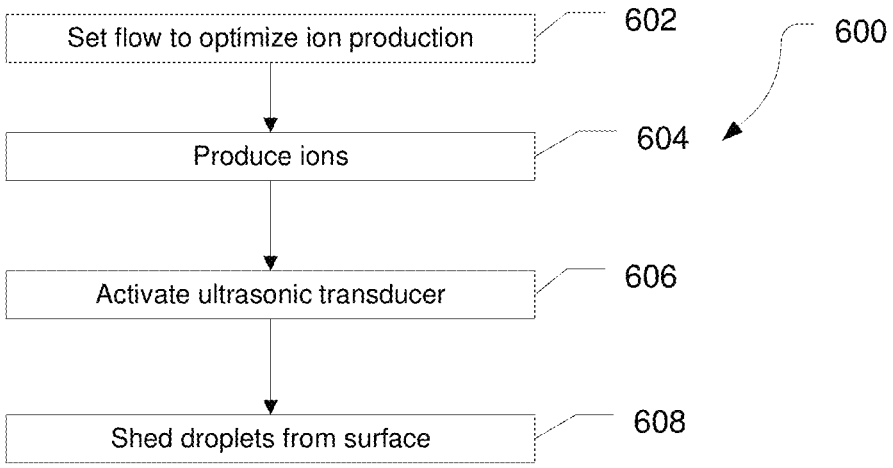
FIG. 6 is a flow diagram illustrating an exemplary method for reducing accumulation of material on a surface of an ion source, in accordance with various embodiments.
Figure 7:
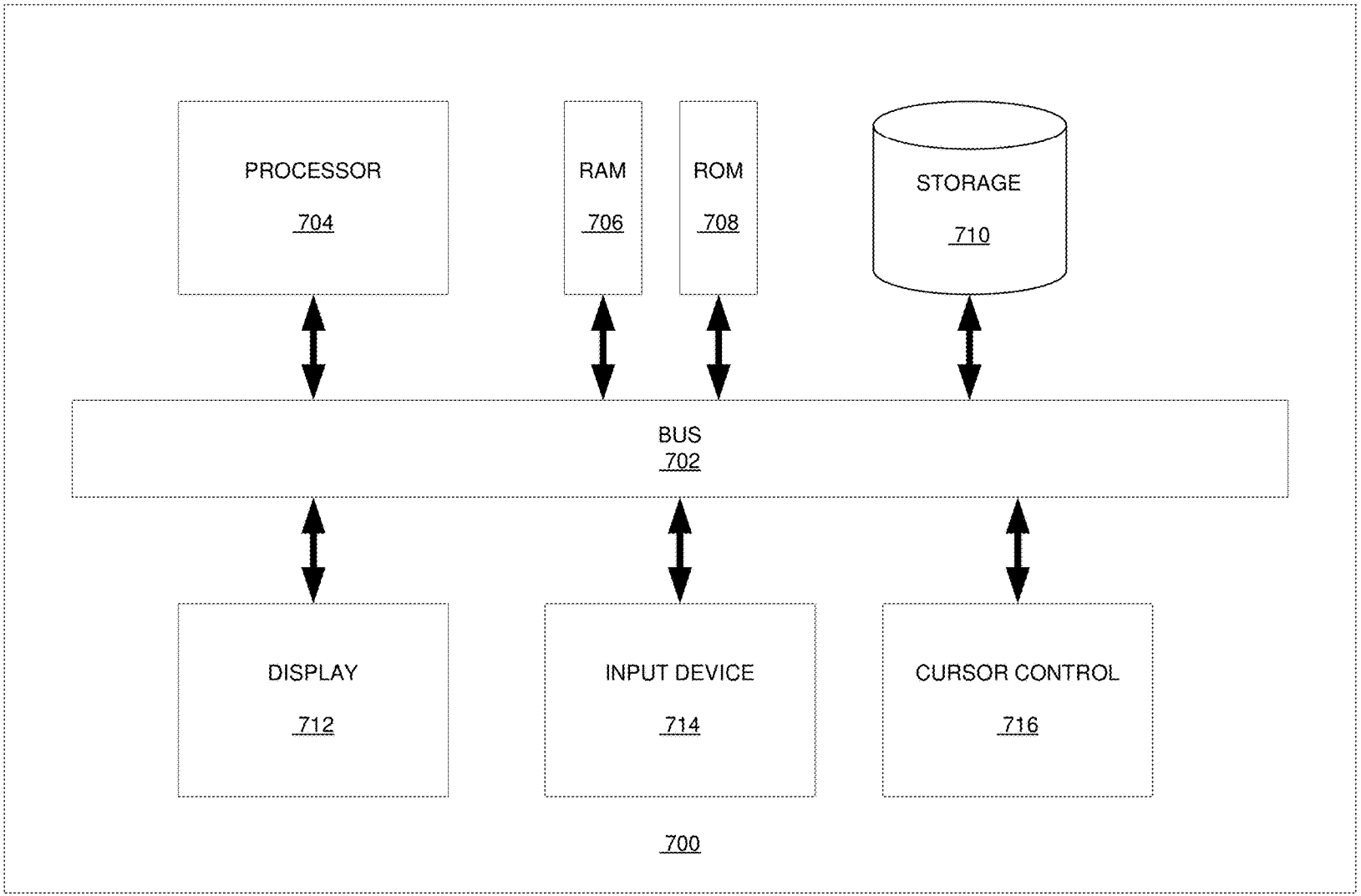
FIG. 7 is a block diagram illustrating an exemplary computer system, in accordance with various embodiments.

FIG. 6 illustrates an exemplary method 600 of reducing or substantially preventing deposition of material on a surface of an ion source housing, such as a sweep cone or a sweep cone shield. At 602, a solvent flow and a gas flow can be adjusted for the production of ions, and ions can be produced at 604. The solvent flow can include a solvent and molecules from a sample to be ionized. The gas flow can be a nebulizing gas to aid in the removal of the solvent from the molecules for the production of ions.

At 606, an ultrasonic transducer embedded or otherwise attached to the surface can be activated, and, at 608, solvent droplets can be shed from the surface. The ultrasonic transducer can cause ultrasonic vibrations at the surface to aid in removal of solvent droplets and substantially prevent deposition of material on the surface.

Computer-Implemented System

FIG. 8 is a block diagram that illustrates a computer system 800, upon which embodiments of the present teachings may be implemented as which may form all or part of controller 108 of mass spectrometry platform 100 depicted in FIG. 1. In various embodiments, computer system 800 can include a bus 802 or other communication mechanism for communicating information, and a processor 804 coupled with bus 802 for processing information. In various embodiments, computer system 800 can also include a memory 806, which can be a random access memory (RAM) or other dynamic storage device, coupled to bus 802 for determining base calls, and instructions to be executed by processor 804. Memory 806 also can be used for storing temporary variables or other intermediate information during execution of instructions to be executed by processor 804. In various embodiments, computer system 800 can further include a read only memory (ROM) 808 or other static storage device coupled to bus 802 for storing static information and instructions for processor 804. A storage device 810, such as a magnetic disk or optical disk, can be provided and coupled to bus 802 for storing information and instructions.

In various embodiments, computer system 800 can be coupled via bus 802 to a display 812, such as a cathode ray tube (CRT) or liquid crystal display (LCD), for displaying information to a computer user. An input device 814, including alphanumeric and other keys, can be coupled to bus 802 for communicating information and command selections to processor 804. Another type of user input device is a cursor control 816, such as a mouse, a trackball or cursor direction keys for communicating direction information and command selections to processor 804 and for controlling cursor movement on display 812. This input device typically has two degrees of freedom in two axes, a first axis (i.e., x) and a second axis (i.e., y), that allows the device to specify positions in a plane.

A computer system 800 can perform the present teachings. Consistent with certain implementations of the present teachings, results can be provided by computer system 800 in response to processor 804 executing one or more sequences of one or more instructions contained in memory 806. Such instructions can be read into memory 806 from another computer-readable medium, such as storage device 810. Execution of the sequences of instructions contained in memory 806 can cause processor 804 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 804 for execution. Such a medium can take many forms, including but not limited to, non-volatile media, volatile media, and transmission media. Examples of non-volatile media can include, but are not limited to, optical or magnetic disks, such as storage device 810. Examples of volatile media can include, but are not limited to, dynamic memory, such as memory 806. Examples of transmission media can include, but are not limited to, coaxial cables, copper wire, and fiber optics, including the wires that comprise bus 802.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, G, etc.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A method for removing deposits in a mass spectrometer ion source housing comprising:

delivering a liquid from a liquid source to a surface within the ion source housing; and activating an ultrasonic transducer embedded within the surface to ultrasonically remove the deposit.

2. The method of claim 1 wherein the surface is a sweep cone or a sweep cone shield.

3. The method of claim 1 wherein the liquid source is an electrospray ionization source or a nebulizer of an APCI source.

4. The method of claim 1 wherein the mass spectrometer is a liquid chromatography-mass spectrometer or an ion chromatography-mass spectrometer.

5. The method of claim 1 wherein applying the liquid and activating the ultrasonic transducer occurs during a cleaning cycle to remove deposited material from the sweep cone shield.

6. The method of claim 5 further comprising changing the volume of a nebulizer gas supplied to the liquid source and or changing the flow of liquid to the liquid source to increase the size of drops delivered to the surface during the cleaning cycle.

7. The method of claim 1 further wherein activating the ultrasonic transducer occurs during ionization to reduce the amount of material deposited on the surface.

8. A liquid based ion source housing of a mass spectrometer, comprising:

a liquid-based ion source including
- a needle for delivery of a liquid;
- a nebulizer gas conduit to provide a nebulizer gas; and
- a heater; and a sweep cone including an imbedded ultrasonic transducer.

9. The liquid based ion source housing of claim 8 further comprising an ion source controller configured to control a volume of nebulizer gas supplied to the liquid-based ion source; control the heater; and activate the ultrasonic transducer.

10. The liquid based ion source housing of claim 9 wherein the ion source controller is further configured to change the volume of nebulizer gas to flow a liquid onto the sweep cone while the ultrasonic transducer is activated to remove deposited material from the sweep cone.

11. The liquid based ion source housing of claim 9 wherein the ion source controller is further configured to activate the ultrasonic transducer during ionization to reduce the amount of material deposited on the sweep cone.

12. The liquid based ion source housing of claim 8 wherein the liquid-based ion source is an electrospray ionization source.

13. The liquid based ion source housing of claim 8 wherein the liquid-based ion source is an atmospheric pressure chemical ionization source and further includes a corona discharge needle.

14. The liquid based ion source housing of claim 8 wherein the mass spectrometer is a liquid chromatography-mass spectrometer or an ion chromatography-mass spectrometer.

15. A liquid based ion source housing of a mass spectrometer, comprising:

a liquid-based ion source including
- a needle for delivery of a liquid;
- a nebulizer gas conduit to provide a nebulizer gas; and
- a heater;

a sweep cone; and a sweep cone shield including an imbedded ultrasonic transducer.

16. The liquid based ion source housing of claim 15 further comprising an ion source controller configured to control a volume of nebulizer gas supplied to the liquid-based ion source; control the heater; and activate the ultrasonic transducer.

17. The liquid based ion source housing of claim 16 wherein the ion source controller is further configured to change the volume of nebulizer gas to flow a liquid onto the sweep cone while the ultrasonic transducer is activated to remove deposited material from the sweep cone shield.

18. The liquid based ion source housing of claim 15 wherein the ion source controller is further configured to activate the ultrasonic transducer during ionization to reduce the amount of material deposited on the sweep cone shield.

19. The liquid based ion source housing of claim 15 wherein the liquid-based ion source is an electrospray ionization source.

20. The liquid based ion source housing of claim 15 wherein the liquid-based ion source is an atmospheric pressure chemical ionization source and further includes a corona discharge needle.

21. The liquid based ion source housing of claim 15 wherein the mass spectrometer is a liquid chromatography-mass spectrometer or an ion chromatography-mass spectrometer.

* * * * *